US005192185A

United States Patent [19]

Leonard

[11] Patent Number: 5,192,185

[45] Date of Patent: Mar. 9, 1993

[54] SHROUD LINERS

[75] Inventor: John F. Leonard, Bristol, England

[73] Assignee: Rolls-Royce plc, London, England

[21] Appl. No.: 785,013

[22] Filed: Oct. 30, 1991

[30] Foreign Application Priority Data

Nov. 1, 1990 [GB] United Kingdom ..... 9023880

[51] Int. Cl.[5] ..... F01D 5/00

[52] U.S. Cl. ..... 415/170.1; 415/173.3; 415/173.6; 415/173.7; 415/174.2

[58] Field of Search ..... 415/173.1, 173.2, 173.3, 415/173.6, 173.7, 174.2, 170.1

[56] References Cited

U.S. PATENT DOCUMENTS 3,694,882 10/1972 Desmond ..... 415/173.6

4,295,787 10/1981 Lardellier ..... 415/173.6

5,044,881 9/1991 Dodd et al. ..... 415/173.3

*Primary Examiner*—Edward K. Look

*Assistant Examiner*—Mark Sgantzos

*Attorney, Agent, or Firm*—Oliff & Berridge

[57] ABSTRACT

A shroud liner has a hooked downstream end passing between a stator vane and a casing so that in operation the gas loads on the vane cause the liner to be held between the vane and the casing. The shroud liner also has a resilient upstream end fitting between a second stator vane and the casing so that in operation gas loads on the vane cause it to move towards the casing, compressing the shroud liner. As a result the shroud liner is securely held in place at its downstream end, but can slide relative to the casing and vanes at its upstream end to allow for thermal expansion.

2 Claims, 3 Drawing Sheets

SHROUD LINERS

BACKGROUND OF THE INVENTION

This invention relates to a shroud liner and particularly to a shroud liner for use in a gas turbine.

In gas turbines it is desirable to have as small a gap as possible between the tips of the turbine blades and the surrounding casing in order to increase the efficiency of the turbine. This is achieved by surrounding the gas turbine with a ring of abradable material. As the turbine rotates the turbine blades cut a path through the abradable material, so ensuring that only very small gaps are left between the turbine blade tips and the surface of the abradable material. Unfortunately such abradable materials tend to erode slowly in the extreme environment found within a gas turbine. As a result components carrying the abradable material must be regularly replaced.

In order to make replacement of the abradable material simple is it supported by thin metal shroud liners which are in turn attached to the structural casing of the turbine, rather than being directly supported by the turbine structural casing. These shroud liners are held preferably in a fixed position relative to the turbine blade tips.

In the past attachment methods have been complex, making it time consuming and difficult to assemble and disassemble the turbine. The components have also tended to be costly and complex. This is undesirable in consumable components.

This invention was intended to overcome these drawbacks by employing the stator vanes to hold the shroud liners in position.

SUMMARY OF THE INVENTION

This invention provides a shroud liner for use in a gas turbine, the turbine including a casing and a first set of stator vanes and a second set of stator vanes; the shroud liner having a fist portion at 9 downstream end thereof and a second resilient portion fat an upstream end thereof, the first portion being shaped to fit between the first set of vanes and the casing and the second portion being shaped to fit between the second set of vanes and the casing, said first and second portions being arranged so that, in operation, gas loads on the vanes compress the first nd second portions between the vanes and the casing so that the first portion is held between the first set of vanes and the casing while the second resilient portion is compressed between the second set of vanes and the casing but able to move relative thereto.

BRIEF DESCRIPTION OF THE DRAWINGS

A shroud liner employing the invention is described by way of example only in the accompanying diagrammatic figures in which.

DETAILED DESCRIPTION OF A PREFERRED EMBODIMENT

Figure 1:
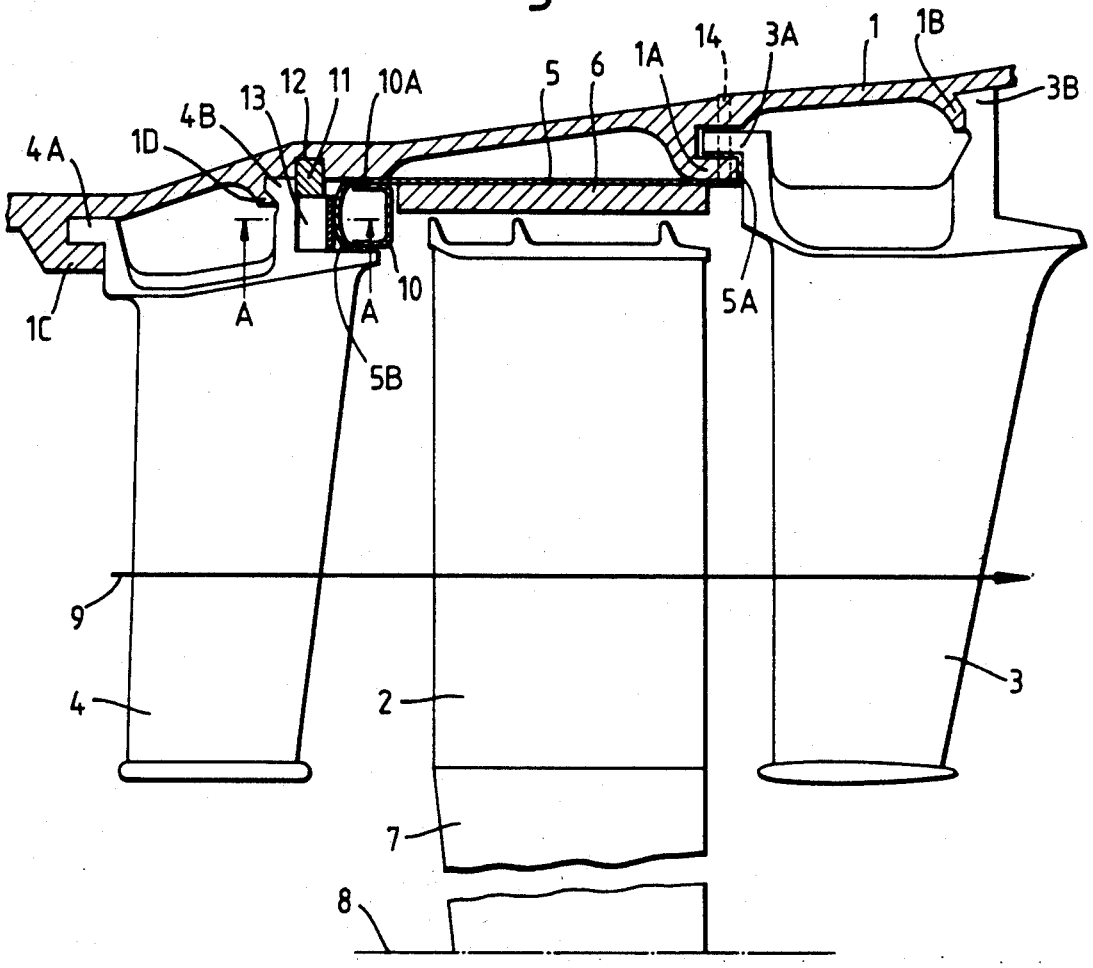
FIG. 1 shows a cross section through a gas turbine including shroud liners according to the invention.
Figure 2:
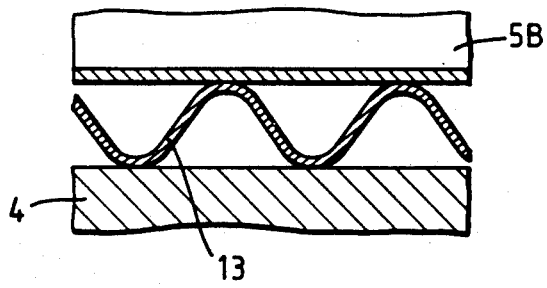
FIG. 2 shows a cross section along the line A—A in FIG. 1.

Referring to FIGS. 1 and 2 a gas turbine has a casing 1 and a plurality of rotor blades 2. The rotor blades 2 are attached to a turbine disc 7 and rotate about an axis 8. In operation gas flows through the turbine in the direction of the arrow 9. A first plurality of stator vanes 3 are attached to the casing 1 downstream of the rotor blades 2 and a second plurality of stator vanes 4 are attached to the casing 1 upstream of the rotor blades 2. The number of stator vanes 3 is equal to the number of stator vanes 4.

A thin metal shroud liner bearing an abradable layer 6 of honeycomb material is situated around the rotor blades 2. The shroud liner is formed by a number of identical abutting segments 5 cooperating to form a ring around the rotor blades 2. Each segment has an abradable layer 6 of honeycomb material extending along a part of its length adjacent the rotor blades 2. The honeycomb material is formed by a honeycomb like structure of thin walled metal cells filled with an abradable ceramic.

The number of segments forming the shroud liner is the same as the number of stator vanes 3 or 4.

Each of the stator vanes 3 is attached to the casing 1 by a first projection 3A on its upstream radially outermost tip, and a second projection 3B on its downstream radially outermost tip, the projections 3A and 3B slot under continuous circumferential hooks 1A and 1B respectively on the casing 1.

Similarly each of the stator vanes 4 is attached to the casing 1 by first and second projections 4A and 4B projecting upstream at its upstream and downstream radially outermost edges respectively. The projections 4A and 4B slot under continuous circumferential hooks 1C and 1D respectively on the casing 1.

Each shroud liner segment 5 has a first, hooked downstream portion 5A which fits around the hook 1A and between the hook 1A and the projection 3A of one of the stator vanes 3.

Each shroud liner segment 5 also has second, resilient upstream portion 5B which is turned back on itself to form a U shape. This U shaped portion 5B fits between the base of one of the stator blades 4 and the casing 1. The U shaped portion 5B is sized so that it is held in compression between the vane 4 and the casing 1, this compression ensures that the portion 5B always bears on the vane 4 and the casing 1 and so forms a good gas seal between them. The U shaped portion 5B would generate turbulence in the gas flow through the turbine because the gas passing through the turbine would enter the U shaped portion 5B and form eddys. In order to prevent this a resilient C ring 10 is placed within the U shaped portion 5B to prevent the gas flow entering the U shaped portion 5B and is brazed to the shroud liner segment 5 along its radially outermost edge 10A only. To ease fitting and replacement the C ring 10 is formed in segments so that each shroud liner segment 5 has its U shaped portion 5B occupied by a single C ring segment 10.

The C ring 10 is brazed to the U shaped portion 5B along only one edge and is able to slide relative to the U shaped portion 5B along its other edge so that the U shaped portion 5B retains its resilience, if the C ring 10 were brazed to the U shaped portion along both edges the resulting box section would be rigid.

In order to prevent the stator blades 4 moving downstream, which would disengage the projections 4A and 4B from the holes 1C and 1D and release the blades 4 from the casing 1, a segmented ring 11 is placed in a circumferential recess 12 in the casing 1 behind the blades 4. The segmented ring 11 bears on the downstream edge of the stator blades 4 and urges the projections 4A and 4B against the hooks 1C and 1D.

A retaining ring formed by a wave spring 13 is placed between the stator vane 4 and the segmented ring 11 to hold the segments of the ring 11 in the recess 12. The wave spring 13 extends in a full circle around the turbine, broken at one point to allow for thermal expansion and contraction of the turbine, and is formed as a sinusoidal wave in a circumferential plane, as shown in FIG. 2. The wave spring 13 contacts the stator blades 4 and the shroud liner segments 5 at the extremities of its sinusoidal wave form.

When the turbine is operating gas loads on the vanes 3 and 4 will cause them to rotate anticlockwise about their attachment to the casing 1. This causes the projection 3A on the vane 3 to bear against the radially outermost surface of the circumferential hook 1A, trapping the hooked portion 5A of the shroud liner segment 5 between them and so holding the shroud liner 5 securely in place. This also causes the stator vanes 4 to move towards the casing 1 at their downstream ends. As a result the projection 4B is urged against the casing 1, the vane 4 also urges the wave spring 13 against the segmented ring 11 and the segmented ring 11 in turn against the casing 1. Each vane 4 also urges the U shaped portion 5B of a shroud liner segment 5 against the casing 1, but because the U shaped portions 5B and their enclosed C ring segments 10 are resilient they will bend rather than being trapped between the vane 4 and the casing 1.

When the shroud liner segment expands or contracts due to temperature changes it is held stationary at its downstream end where the hooked portion 5A is trapped between the projection 3A and the hook 1A. At the upstream end however, the hooked portion 5B can move upstream or downstream against the wavespring 13 as demanded by the thermal expansion and contraction of the shroud liner segment 5, increasing or reducing the compression acting on the wavespring 13. The U shaped portion 5B can slide between the vane 4 and the casing 1 because the forces acting between it and the vane 4 and the casing 1 are limited by the resilience of the U shaped portion 5B and the C ring segment 10.

A pin 14 is passed through the casing 1, projection 3A, hooked portion 5A and into the hook 1A to secure the vane 3 and shroud liner segment 5 against rotation about the axis 8 of the turbine.

Figure 3:
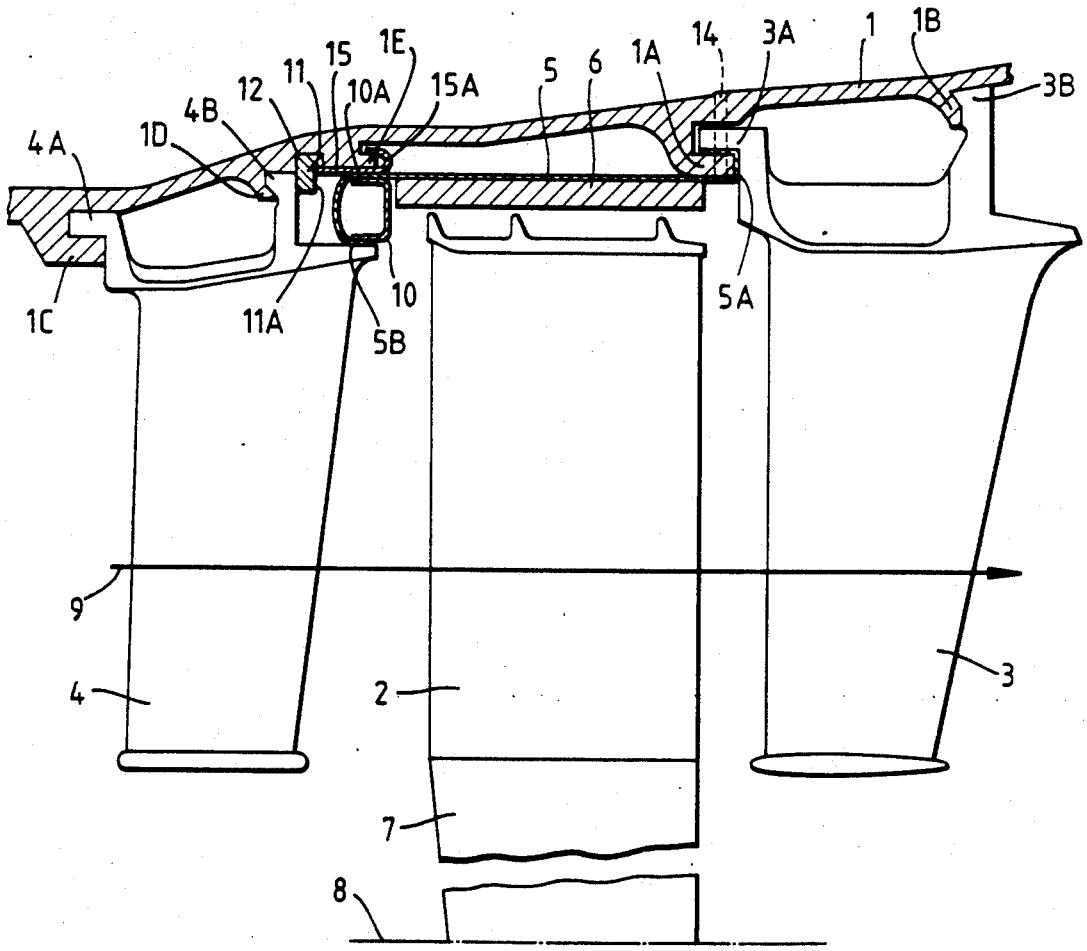
FIG. 3 shows a cross section through a gas turbine including another design of shroud liners according to the invention.

Referring to FIG. 3 a turbine using a slightly different shroud liner design is shown.

This is largely the same as the turbine shown in FIG. 1 except that the wavespring 13 is omitted. A retainer 15 is brazed to each shroud liner segment 5 between the shroud liner segment 5 and the casing 1. Each retainer 15 projects beyond the end of the U shaped portion 5B and cooperates with a recess 11A in one of the segments of the segmented ring 11 to retain the segment in the recess 12.

Each retainer 15 also has a hooked portion 15A at its downstream end which hooks over a circumferential projection 1E from the casing 1. The hooked portion 15A and projection 1E are a precaution against the U shaped portion 5B of the shroud liner segment 5 loosing its resilience, due to thermal fatigue for example. If this occurs the U shaped portion 5B will no longer be securely held between the stator vane 3 and the casing 1 and could as a result move radially, upsetting the turbine blade tip clearance, but the hooked portion 15A and projection 1E will prevent this.

Figure 4:
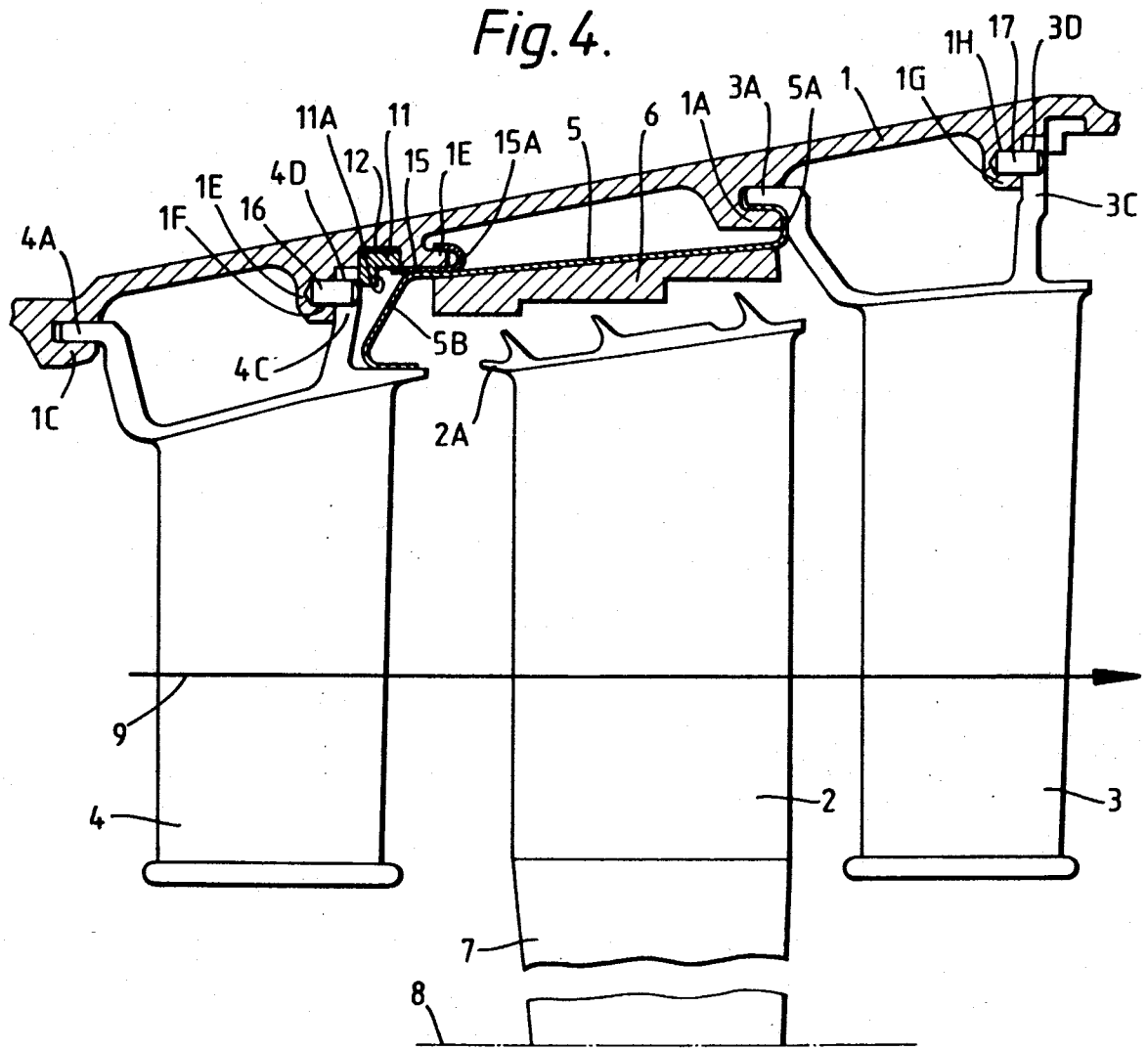
FIG. 4 shows a cross section through a gas turbine including a further design of shroud liners according to the invention, similar parts having the same reference numerals throughout.

Referring now to FIG. 4 a third design is shown. This is similar to the design shown in FIG. 3, the main differences being the method of securing the vanes 3 and 4 to the casing 1 and the details of the portion 5B of the shroud liner segments 5.

The gas turbine has a first plurality of stator vanes 4 upstream of rotor blades 1, which are in turn upstream of a second plurality of stator vanes 3.

Each stator vane 4 has a first projection 4A projecting upstream from its radially outermost upstream edge, and has a third projection 4C projecting outward from its radially outermost downstream edge.

The projection 4A slots under the continuous circumferential hook 1C as before, while the projection 4C lies adjacent to a circumferential flange 1E on the casing 1.

Each projection 4C contains a hole 4D through which a pin 16 is inserted into a recess 1F in the flange 1E. A plurality of recesses 1F are evenly spaced around the flange 1E.

Each vane 4 is thus attached to the casing 1 by the projection 4A slotting under the circumferential hook 1C and by the pin 16 passing through the projection 4C and into the flange 1E. In order to prevent the pin 16 falling out or the gas loads on the vane 4 moving it downstream out of engagement with the hook 1C and flange 1E and detaching it from the casing 1 a segmented ring 11 is fitted into a recess 12 in the casing 1 and bears against the downstream face of the projection 4C, preventing the vane 4 from moving downstream and retaining the pin 16 within the recess 1F and the hole 4D.

The segmented ring 11 is held in place in the recess 12 by projections from the retainers 15 cooperating with recesses 11A in the segments of the segmented ring 11, as in the design shown in FIG. 3.

Similarly the vanes 3 bear projections 3C containing holes 3D through which pins 17 are inserted into recesses 1H in a flange 1G.

The shroud liner segments 5 are secured by hooked portions 5A and U shaped portions 5B as before, but no C ring segments are used.

This is done because without C ring segments within the U shaped portions 5B of the shroud liner segments 5 the rotor assembly, comprising the disk 7 and blades 2, has a greater range of axial movement relative to the casing than if C ring segments are used.

This greater range of axial movement is available because the rotor assembly can move upstream parallel to the axis 8 from the position shown in FIG. 4 until the upstream tips 2A of the blades 2 are within the U shaped portions 5A, between the bases of the vanes 14 and the casing 1. This would not be possible if C ring segments were used because the blade tips would colide with the C ring segments.

The single stage turbines described above have a single set of turbine blades 2 flanked by two sets of stator vanes 3 and 4 which hold a set of shroud liner segments 5 in place around the circumference of the turbine. In a multi-stage turbine each turbine stage could have its corresponding set of shroud liners, with the vane sets between turbine stages each holding two sets of shroud liners in place, one set for the upstream turbine and one set for the downstream turbine.

Each shroud liner segment 5 can be formed from a single sheet of metal bearing a layer of honeycomb material 6 on its centre section and bent to form the hooked portion 5A and the U shaped portion 5B.

The systems described above have each shroud liner segment 5 in contact with one stator vane 3 and one stator vane 4, it would be possible to have the shroud liner segments 5 and stator vanes 3 and 4 arranged so that each shroud liner segment 5 was in contact at each end with two vanes 3 or 4 and each of the vanes 3 and 4 was in contact with two shroud liner segments 5.

The number of vanes 3 and 4 and the number of shroud liner segments may be different. This would require that each vane 3 and 4 was in contact with a number of segments 5, or vice versa.

The C ring 10 could be omitted in the designs of FIGS. 1 to 3 as it is in the design of FIG. 4. If preferred a C ring could be used in the design of FIG. 4 like the C ring 10 in the designs of FIGS. 1 to 3.

The abradable material used in the above example is a honeycomb material, this could be replaced by any other suitable abradable material such as a porous ceramic or a multi-layered abradable ceramic.

The stator vanes 3 and 4 in the examples are individually attached to the casing 1. The stator vanes 3 and 4 could instead be joined together to form a number of stator segments each comprising a plurality of stator vanes 3 or 4 and the stator segments attached to the casing 1 without altering the invention.

I claim:

1. A shroud liner for use in a gas turbine, the turbine including a casing and a first set of stator vanes and a second set of stator vanes; the shroud liner being formed of sheet metal bearing an abradable coating on a part of one face, the shroud liner having a first portion at a downstream end thereto and a second resilient portion at its upstream end thereto, the first portion being shaped to fit between the first set of vanes and the casing, the resilient second portion comprising the sheet metal of the shroud liner formed in a U shape to fit between the second set of vanes and the casing, and a resilient element which closes the open end of the U shape, said first and second portions being arranged so that, in operation, gas loads on the vanes compress the first and second portions between the vanes and the casing so that the first portion is held between the first set of vanes and the casing while the second resilient portion is compressed between the second set of vanes and the casing but able to move relative thereto.

2. A shroud liner as claimed in claim 1 where each shroud liner has a first portion which fits between one of the first set of stator vanes and the casing and a resilient second portion which fits between one of the second set of stator vanes and the casing.

* * * * *